US010271638B1

(12) United States Patent
Goetz et al.

(10) Patent No.: US 10,271,638 B1
(45) Date of Patent: Apr. 30, 2019

(54) SPATTER CONTROL GUARD FOR A DRAIN CLEANING BRUSH

(71) Applicants: Charles William Goetz, Woodbury, MN (US); Brandon Daniel Goetz, Woodbury, MN (US)

(72) Inventors: Charles William Goetz, Woodbury, MN (US); Brandon Daniel Goetz, Woodbury, MN (US)

( * ) Notice: Subject to any disclaimer, the term of this patent is extended or adjusted under 35 U.S.C. 154(b) by 46 days.

(21) Appl. No.: 15/727,960

(22) Filed: Oct. 9, 2017

Related U.S. Application Data

(60) Provisional application No. 62/408,053, filed on Oct. 13, 2016.

(51) Int. Cl.

| | |
|---|---|
| ***B08B 13/00*** | (2006.01) |
| ***A46B 17/08*** | (2006.01) |
| ***B08B 9/043*** | (2006.01) |
| ***A46B 9/02*** | (2006.01) |

(52) U.S. Cl.
CPC ..... *A46B 17/08* (2013.01); *A46B 9/026* (2013.01); *B08B 9/0436* (2013.01); *A46B 2200/3013* (2013.01)

(58) Field of Classification Search
None
See application file for complete search history.

(56) References Cited

U.S. PATENT DOCUMENTS 6,199,241 B1 * 3/2001 Anumah ..... A46B 9/02 15/145

OTHER PUBLICATIONS https://web.archive.org/web/20141223200501/http://www.malish.com:80/, Feb. 8, 2018.

* cited by examiner

*Primary Examiner* — Eric W Golightly
(74) *Attorney, Agent, or Firm* — Sherrill Law Offices, PLLC

(57) ABSTRACT

A spatter control guard for use in connection with a cleaning brush having a cleaning head attached to a distal end of a handle, the spatter control guard comprising a supple planar expanse of material having (i) a central orifice configured and arranged to allow passage of the handle and prohibit passage of the cleaning head, and (ii) an area of about 20 $in^2$ to about 300 $in^2$ excluding the area of the central orifice, whereby the spatter control guard inherently droops under force of gravity at room temperature into a U channel protective cover over the cleaning head of a cleaning brush when positioned atop the cleaning head with the handle of the cleaning brush extending through the orifice.

19 Claims, 1 Drawing Sheet

SPATTER CONTROL GUARD FOR A DRAIN CLEANING BRUSH

BACKGROUND

Drains are commonly cleaned with a drain cleaning brush, often in conjunction with a chemical drain cleaner.

Agitation of the brush during cleaning of a drain produces backsplash and spattering of the harsh cleaning chemicals onto the surrounding environment, including workers.

Accordingly, a strong need exists for a device capable of limiting the disagreeable and potentially harmful backsplash and spattering so often associated with the cleaning of drains, and in particular a device that provides this benefit at minimal expense and with minimal impact upon ease of use and cleaning performance.

SUMMARY OF THE INVENTION

A first aspect of the invention is a spatter control guard for use in connection with a cleaning brush. The spatter control guard comprises a supple planar expanse of material having (i) a central orifice configured and arranged to allow passage of a handle on the cleaning brush while prohibiting passage of the cleaning head, and (ii) an area of about 20 $in^2$ to about 300 $in^2$ excluding the area of the central orifice. The spatter control guard inherently droops under force of gravity at room temperature into a U channel protective cover over the cleaning head of a cleaning brush when positioned atop the cleaning head with the handle of the cleaning brush extending through the orifice.

A second aspect of the invention is a drain cleaning tool that includes a drain cleaning brush and a spatter control guard. The drain cleaning brush has a cleaning head attached to a distal end of a handle. The spatter control guard is a supple planar expanse of material having (i) a central orifice configured and arranged to allow passage of the handle while prohibiting passage of the cleaning head, and (ii) an area of about 20 $in^2$ to about 300 $in^2$ excluding the area of the central orifice. The spatter control guard inherently droops under force of gravity at room temperature into a U channel protective cover over the cleaning head of a drain cleaning brush when positioned atop the cleaning head with the handle of the drain cleaning brush extending through the orifice.

A third aspect of the invention is a method of cleaning a drain. The method includes the steps of (a) obtaining a drain cleaning brush, (b) obtaining a spatter control guard in accordance with the first aspect of the invention, (c) inserting a proximal end of the handle through the orifice in the spatter control guard and sliding the spatter control guard along the longitudinal length of the handle into contact with the cleaning head, whereby the spatter control guard droops under force of gravity into a U channel protective cover over the cleaning head, (d) inserting the cleaning head into a drain until the spatter control guard rests upon and covers the drain, (e) reciprocating the cleaning head along a length of the drain, whereby the handle concomitantly reciprocates through the orifice in the spatter control guard, and (e) removing the cleaning head from the cleaned drain.

A fourth aspect of the invention is a method of cleaning a drain. The method includes the steps of (a) obtaining a drain cleaning tool in accordance with the second aspect of the invention, (b) inserting a proximal end of the handle through the orifice in the spatter control guard and sliding the spatter control guard along the longitudinal length of the handle into contact with the cleaning head, whereby the spatter control guard droops under force of gravity into a U channel protective cover over the cleaning head, (c) inserting the cleaning head into a drain until the spatter control guard rests upon and covers the drain, (d) reciprocating the cleaning head along a length of the drain, whereby the handle concomitantly reciprocates through the orifice in the spatter control guard, and (e) removing the cleaning head from the cleaned drain.

A fifth aspect of the invention is a method of cleaning a used spatter control guard for reuse. The method includes the steps of (a) sliding a soiled spatter control guard in accordance with the first aspect of the invention off a drain cleaning brush handle subsequent to use of the drain cleaning brush to clean a drain, (b) rinsing off the soiled spatter control guard, and (c) hanging the rinsed spatter control guard from a projection extended through the orifice of the spatter control guard.

DETAILED DESCRIPTION OF A PREFERRED EMBODIMENT

Nomenclature

Figure 1:
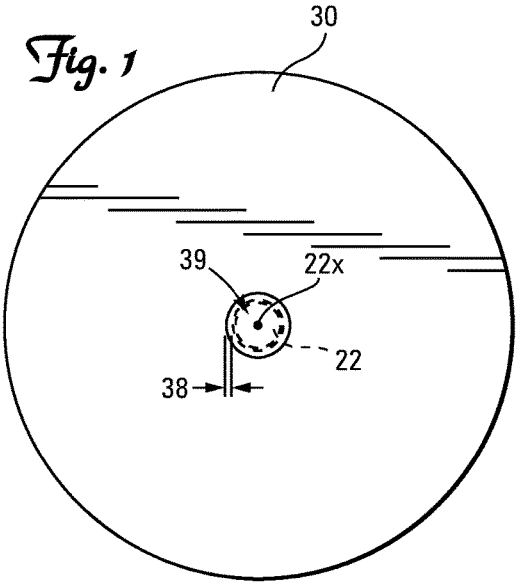
FIG. 1 is a top view of one embodiment of a spatter control guard in accordance with the invention.
Figure 2:
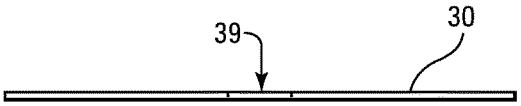
FIG. 2 is a side view of the spatter control guard depicted in FIG. 1.

10 Drain Cleaning Tool
20 Drain Cleaning Brush
21 Cleaning Head
21*b* Bristles on Cleaning Head
22 Handle
22*a* Proximal End of Handle
22*b* Distal End of Handle
22*x* Longitudinal Length of Handle
30 Spatter Control Guard
38 Open Annulus
39 Central Orifice
D Drain

Definitions

As utilized herein, including the claims, the term "room temperature" means 21° C.

As utilized herein, including the claims, the phrase "360° bristle brush" means a brush head with bristles radially projecting 360° around the distal end of a handle.

Description

Construction

Referring to FIGS. 1-4, the invention is a spatter control guard 30 for use in connection with a drain cleaning brush 20, such as any of the ubiquitous drain cleaning brushes 20 having a 360° bristled cleaning head 21 attached to the distal end 22*b* of a 12 to 36 inch long handle 22, to form a drain cleaning tool 10. The spatter control guard 30 is also suitable for use in connection with other similar cleaning brushes 20 such as a toilet bowl brush or a chimney cleaning brush.

Figure 4:
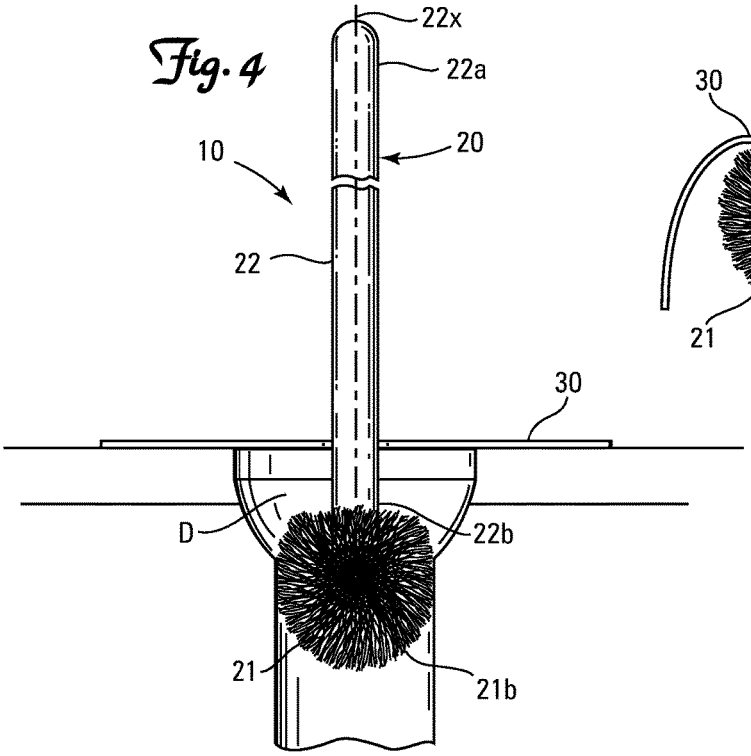
FIG. 4 is a side view of the drain cleaning tool depicted in FIG. 3, with the cleaning head on the brush inserted into a drain.

Referring to FIG. 4, the spatter control guard 30 is a supple, planar expanse of material with a central orifice 39. The guard 30 is sized to completely cover a drain D. An area of about 20 $in^2$ to about 300 $in^2$, excluding the area of the central orifice 39, is generally effective for covering the vast majority of drains D. A circular disk of about 20 $in^2$ to about 100 $in^2$ is generally preferred as most drains D are of circular cross-section.

Figure 3:
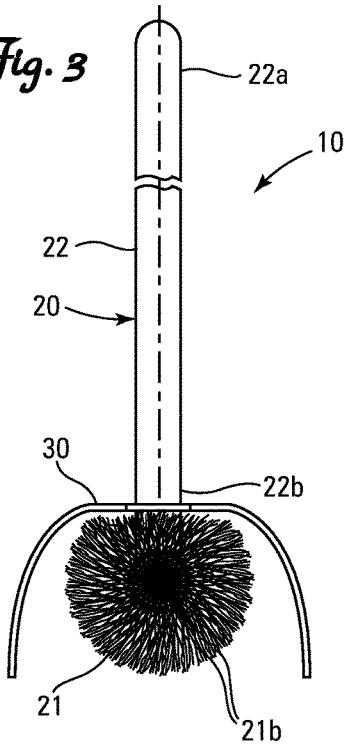
FIG. 3 is a side view of the spatter control guard depicted in FIG. 1 installed upon a drain cleaning brush so as to form a drain cleaning tool, prior to insertion of the cleaning head on the brush into a drain.

Referring to FIGS. 1, 3 and 4, the central orifice 39 through the planar expanse of material is configured and arranged to allow passage of the handle 22 on a drain cleaning brush 20 while prohibiting passage of the cleaning head 21 attached to the handle 22. These handles 22 typically have a circular cross-section with a circumference of about 2 in to 4 inches. Hence, a circular central orifice 39 with a diameter of about 0.5 to 2 inches is generally effective for allowing passage of the handle 22 while prohibiting passage of the cleaning head 21. The central orifice 39 is preferably sized relative to the diameter of a handle 22 extending therethrough so as to leave an open annulus 38 of about 0.1 in to 0.3 in around the periphery of the handle 22. An open toroidal margin 38 of less than about 0.1 inch results in an undesired frictional lifting of the spatter control guard 30 off the drain D as the drain cleaning brush 20 is lifted, while an open annulus 38 of greater than about 0.3 inches allows spattering to occur through the open annulus 38 during use.

Referring to FIGS. 3 and 4, the planar expanse of material is preferably waterproof, and preferably constructed, configured and arranged so that it will inherently droop under force of gravity at room temperature into a U channel protective cover over the cleaning head 21 of a drain cleaning brush 20 when positioned atop the cleaning head 21 with the handle 22 of the drain cleaning brush 20 extending through the orifice 39, but with sufficient firmness that it will not crumple into a drain D during cleaning. Such drooping of the spatter control guard 30 allows use of the drain cleaning tool 10 in tight spaces, such as when a floor drain is positioned in a corner of a room. A 20 to 100 mil thick elastomeric membrane, such as synthetic rubber, having a Shore Hardness of about 10 to 60 OO, generally provides the proper balancing of flexibility and firmness. Construction of the spatter control guard 30 from an elastomeric material, such as EPDM, also allows the orifice 39 to be stretched over an enlarged proximal end 22*a* of a drain cleaning brush handle 22.

The spatter control guard 30 limits backsplash and spattering so as to limit soiling and staining of the surrounding environment and keep any drain cleaning solution within the drain D to maximize its effectiveness.

Use

Referring to FIGS. 3 and 4, the drain cleaning tool 10 is used to clean a drain D by (i) inserting a proximal end 22*a* of the handle 22 through the orifice 39 in the spatter control guard 30 and sliding the spatter control guard 30 along the longitudinal length 22*x* of the handle 22 until it contacts and droops over the cleaning head 21, (ii) inserting the cleaning head 21 into the drain D until the spatter control guard 30 rests upon and covers the drain D, (iii) reciprocating the cleaning head 21 along a length of the drain D, with the handle 22 concomitantly reciprocating through the orifice 39 in the spatter control guard 30, and then (iv) removing the cleaning head 21 from the freshly cleaned drain D.

We claim:

1. A spatter control guard for use in connection with a cleaning brush having a cleaning head attached to a distal end of a handle, the spatter control guard comprising a supple planar expanse of material having (i) a central orifice configured and arranged to allow passage of the handle and prohibit passage of the cleaning head, and (ii) an area of about 20 $in^2$ to about 300 $in^2$ excluding the area of the central orifice, whereby the spatter control guard inherently droops under force of gravity at room temperature into a U channel protective cover over the cleaning head of a cleaning brush when positioned atop the cleaning head with the handle of the cleaning brush extending through the orifice.

2. The spatter control guard of claim 1 wherein the supple planar expanse of material is a 20 to 100 mil waterproof rubber membrane.

3. The spatter control guard of claim 2 wherein the supple planar expanse of material is neoprene.

4. The spatter control guard of claim 1 wherein the central orifice is a 0.5 to 2 inch diameter circular orifice.

5. The spatter control guard of claim 1 wherein the spatter control guard is a disc having an area of about 20 $in^2$ to about 100 $in^2$ excluding the area of the central orifice.

6. A drain cleaning tool, comprising:

(a) a drain cleaning brush having a cleaning head attached to a distal end of a handle, and (b) a spatter control guard including at least a supple planar expanse of material having (i) a central orifice configured and arranged to allow passage of the handle while prohibiting passage of the cleaning head, and (ii) an area of about 20 $in^2$ to about 300 $in^2$ excluding the area of the central orifice, (c) whereby the spatter control guard inherently droops under force of gravity at room temperature into a U channel protective cover over the cleaning head of the drain cleaning brush when positioned atop the cleaning head with the handle of the drain cleaning brush extending through the orifice.

7. The drain cleaning tool of claim 6 wherein the cleaning head is a bristle brush.

8. The drain cleaning tool of claim 7 wherein the cleaning head is a 360° bristle brush.

9. The drain cleaning tool of claim 6 wherein the handle has a longitudinal length of about 12 in to 36 in, and a circumference of about 2 in to 4 in.

10. The drain cleaning tool of claim 6 wherein the supple planar expanse of material is a 20 to 100 mil waterproof rubber membrane.

11. The drain cleaning tool of claim 10 wherein the supple planar expanse of material is neoprene.

12. The drain cleaning tool of claim 6 wherein the central orifice is a 0.5 to 2 inch diameter circular orifice.

13. The drain cleaning tool of claim 6 wherein the central orifice is larger than the cross-section of the handle.

14. The drain cleaning tool of claim 13 wherein concentric longitudinal alignment of the central orifice and the handle leaves an open annulus of about 0.1 in to 0.3 in around the periphery of the handle.

15. The drain cleaning tool of claim 6 wherein the spatter control guard is a disc having an area of about 20 $in^2$ to about 100 $in^2$ excluding the area of the central orifice.

16. A method of cleaning a drain, comprising the steps of:

(a) obtaining a drain cleaning brush having a cleaning head attached to a distal end of a longitudinally elongated handle, (b) obtaining a spatter control guard in accordance with claim 1, (c) inserting a proximal end of the handle through the orifice in the spatter control guard and sliding the spatter control guard along the longitudinal length of the handle into contact with the cleaning head, whereby the spatter control guard droops under force of gravity into a U channel protective cover over the cleaning head, (d) inserting the cleaning head into a drain until the spatter control guard rests upon and covers the drain, (e) reciprocating the cleaning head along a length of the drain, whereby the handle concomitantly reciprocates through the orifice in the spatter control guard, and (f) removing the cleaning head from the cleaned drain.

17. A method of cleaning a drain, comprising the steps of:

(a) obtaining a drain cleaning tool in accordance with claim 6, (b) inserting a proximal end of the handle through the orifice in the spatter control guard and sliding the spatter control guard along the longitudinal length of the handle into contact with the cleaning head, whereby the spatter control guard droops under force of gravity into a U channel protective cover over the cleaning head, (c) inserting the cleaning head into a drain until the spatter control guard rests upon and covers the drain, (d) reciprocating the cleaning head along a length of the drain, whereby the handle concomitantly reciprocates through the orifice in the spatter control guard, and (e) removing the cleaning head from the cleaned drain.

18. A method of cleaning a drain, comprising the steps of:

(a) obtaining a drain cleaning tool in accordance with claim 14, (b) inserting a proximal end of the handle through the orifice in the spatter control guard and sliding the spatter control guard along the longitudinal length of the handle into contact with the cleaning head, whereby the spatter control guard droops under force of gravity into a U channel protective cover over the cleaning head, (c) inserting the cleaning head into a drain until the spatter control guard rests upon and covers the drain, (d) reciprocating the cleaning head along a length of the drain, whereby the handle concomitantly reciprocates through the orifice in the spatter control guard, and (e) removing the cleaning head from the cleaned drain.

19. A method of cleaning a used spatter control guard for reuse, comprising the steps of:

(a) sliding a soiled spatter control guard in accordance with claim 1 off a drain cleaning brush handle subsequent to use of the drain cleaning brush to clean a drain, (b) rinsing off the soiled spatter control guard, and (c) hanging the rinsed spatter control guard from a projection extended through the orifice of the spatter control guard.

* * * * *